United States Patent [19]

Hayashi

[11] Patent Number: 4,895,604

[45] Date of Patent: Jan. 23, 1990

[54] METHOD AND APPARATUS FOR RINSING MATERIALS OR ARTICLES

[75] Inventor: Noriyuki Hayashi, Hikone, Japan

[73] Assignee: Dainippon Screen Mfg. Co., Ltd., Japan

[21] Appl. No.: 269,496

[22] Filed: Nov. 10, 1988

Related U.S. Application Data

[63] Continuation of Ser. No. 880,124, Jun. 30, 1986, abandoned.

[30] Foreign Application Priority Data

| | | | |
|---|---|---|---|
| Jul. 15, 1985 | [JP] | Japan | 60-154339 |
| Apr. 25, 1986 | [JP] | Japan | 61-94652 |
| Apr. 25, 1986 | [JP] | Japan | 61-94653 |

[51] Int. Cl.[4] ..... B08B 3/00

[52] U.S. Cl. ..... 134/31; 134/18; 134/26; 134/30

[58] Field of Search ..... 134/31, 18, 26, 30

[56] References Cited

U.S. PATENT DOCUMENTS

| | | | |
|---|---|---|---|
| 3,663,293 | 5/1972 | Suprenant et al. | 124/31 |
| 3,699,982 | 10/1972 | Pipkins | 134/31 |
| 4,079,522 | 3/1978 | Ham | 134/11 |
| 4,098,005 | 7/1978 | Wiards | 134/31 |
| 4,186,032 | 1/1980 | Ham | 134/31 |
| 4,628,616 | 12/1986 | Shirai et al. | 134/31 |

*Primary Examiner*—Asok Pal

*Attorney, Agent, or Firm*—Poms, Smith, Lande & Rose

[57] ABSTRACT

A method and an apparatus for rinsing materials or articles to remove deposits attached onto the surfaces of those materials or articles and humidity from the them by vapor of rinsing solvent which is evaporated by heating and filled in a rinsing chamber. In the method or the apparatus when it is detected that the vapor having been cooled to a temperature lower than that of the predetermined reference level, occurence or generation of failure in rinsing operation can be grasped.

7 Claims, 3 Drawing Sheets

METHOD AND APPARATUS FOR RINSING MATERIALS OR ARTICLES

This is a continuation of co-pending application Ser. No. 06/880,124 filed on June 30, 1986, now abandoned.

BACKGROUND OF THE INVENTION

1. Field of the Invention

The invention relates to a method and an apparatus for rinsing materials or articles to eliminate deposits sticking on the surfaces thereof and remove humidity therefrom with vapor generated by heating volatile solvent, such as isopropyl-alcohol, trichroric-ethylene, etc. 2. Prior Art An apparatus for eliminating deposits attached on the surfaces of articles and materials to be rinsed and remove humidity therefrom in which rinsing solvent stored in the lower portion of a rinsing chamber is heated to evaporate, and in the chamber which is filled with vapor materials and/or articles to be rinsed are loaded has been well known. In the afore-mentioned apparatus vapor produced by heating the solvent is cooled by contacting with the materials or the articles which are lower temperature than that of vapor itself. As described the above, vapor is dewed, then rinsing is carried out.

When vapor of the solvent is coagulated, temperature of the materials to be rinsed rises by heat generated when vapor of the solvent is condensated, and after its having reached to saturation temperature of the vapor, it is no longer any merit to hold the vapor in the chamber, for it results in deterioration of rinsing effect and time loss. Accordingly, to improve rinsing efficiency it is required to grasp an ending point of rinsing operation from situation of the inside of the chamber and let the operation finish at an appropriate time.

However, in conventional the apparatus for rinsing materials etc. has been only an apparatus that measures merely whether or not temperature of the solvent reaches to the boiling point, so that it has been impossible to know the above mentioned ending point exactly, which results in consuming unnecessary long rinsing time or lacking in rinsing time to the contrary. Particularly, those materials which are loaded in the rinsing chamber are, according to their sizes, numbers, etc., different in thermal capacities from one another, that is, if thermal capacity is larger, longer rinsing time is required, and if it is smaller, only shorter rinsing time is necessary. However, if a rinsing apparatus is automated without having grasped each thermal capacity of the respective materials, to prevent each of the materials from being insufficient in the rinsing condition, the materials are liable to be set for unnecessary long time in the condition, which results in increasing running cost for the rinsing process.

In addition, as having been performed in the conventional apparatus, merely by measuring temperature of the solvent, it is impossible to know whether or not the chamber is actually filled with vapor of the solvent. Accordingly, though vapor of the solvent is being insufficient in the chamber, there may occur missing operation cases in which materials to be rinsed are overloaded in the chamber. Because of the missing operation, unevenness rinsed marks (stripes or lines, for example) are generated on the surface of the material. However, in the conventional apparatus there is inconvenience that until the rinsing operation finishes, the fact that vapor of the solvent was insufficient in the chamber can not be found.

SUMMARY OF THE INVENTION

It is the first object of the present invention to provide a method for detecting exactly an ending point of rinsing operation of materials loaded in a rinsing chamber.

It is the second object of the present invention to provide an apparatus for detecting exactly an ending point of rinsing operation of materials loaded in a rinsing chamber.

It is the third object of the present invention to provide a method for exactly detecting conditions of vapor of solvent in a chamber whether or not rinsing operation can be performed therein.

It is the fourth object of the present invention to provide an apparatus for exactly detecting conditions of vapor of solvent in a chamber whether or not rinsing operation can be performed therein.

It is the fifth object of the present invention to provide a method for discontinuing rinsing operation, when conditions undesired and unsuitable for the rinsing operation are found by watching vapor conditions in a chamber.

It is the sixth object of the present invention to provide an apparatus for discontinuing rinsing operation, when conditions undesired and unsuitable for the rinsing operation are found by watching vapor conditions in a chamber.

In order to carry out the afore-mentioned objects, according to the present invention, it is adapted that probes of thermometers are disposed at two positions in the chamber one of which is a position of the same level with the upper ends of materials to be loaded and the other is a position which is higher than the upper end of the solvent chamber. Basing on temperatures having been measured by these two thermometers, vapor density in the chamber is detected, and in the case of the vapor density being larger than a predetermined level, rinsing operation is begun after materials having been loaded. The time when temperature of vapor of the solvent returns to a temperature of a desired level after temperature of vapor measured by the probe(s) disposed on the upper position is lowered by loading the materials, or when a necessity time for the temperature of vapor to return the desired level passed is set to be an ending point of the rinsing operation. In addition, when temperature measured by the second probe disposed at the position of which height is same as those of the loaded materials lowers than that of the desired level, with the reason that there may occur failures such as unevenness treatment of rinsing operation etc., the process (rinsing operation) is to be suspended.

As the boiling point of the rinsing solvent is higher than the normal temperature (for example, the boiling point of isopropyl-alcohol 82.4° C.), temperature in the chamber is measured by thermometers disposed at positions of suitable height in the chamber. Thus, according to the present invention, it is possible to know whether or not a level of vapor density at that height reaches to a level (for example, such as saturation level etc.) required for the rinsing process. Distribution of the vapor density in the chamber is higher than that of air, and the solvent evaporated from the bottom of the chamber, so that in regions below a certain height there are filled with saturated vapor, but in regions higher than the height vapor densities change lower accordingly, so that if vapor density is detected to have been saturated at a certain height, it can be confirmed that all regions beneath the height in the chamber are filled with saturated vapor.

Accordingly, by previously obtaining a vapor temperature corresponding to the vapor density required for the rinsing process, in the case of a temperature measured by a thermometer being higher than the previous obtained vapor temperature, it is guaranteed that the height of the upper edge in the range of vapor densities which are applicable to the rinsing process (hereinafter, afore-described "the upper edge" refer to "vapor height") is at least higher than that of the probe of the thermometer. Therefore, when materials are loaded in the chamber, because vapor dews on the surfaces of the materials, the vapor height measured by the first probe disposed at the upper portion of the chamber lowers. Then, for a certain period the materials are moistened by the rinsing solvent to be rinsed, and simultaneously temperature of the materials and the vapor height which accompanies with the temperature of the materials gradually raises. Accordingly, basing on a time when vapor temperature measured by the first probe of the thermometer disposed at the upper portion of the chamber reaches to a certain level (for example, saturated vapor temperature), or basing on a time after necessary period having been passed from the afore-described time, it can be judged that the rinsing process has been completed.

On the other hand, in the course of the rinsing process being performed, when "the vapor height" lowers to a position lower than the upper end of the materials, unevenness in treatment or deposit occurs by making the lower position to a boundary. When vapor temperature measured by a second probe disposed at the same level with the upper end of the materials lowers from the certain level in the course of the rinsing process, these failures are detected and the treatment is suspended.

BRIEF DESCRIPTION OF THE DRAWINGS

Hereinafter, concrete embodiments of the present invention will be explained with reference to the accompanying drawings.

DETAILED DESCRIPTION OF THE INVENTION AND THE PREFERRED EMBODIMENT

Figure 2:
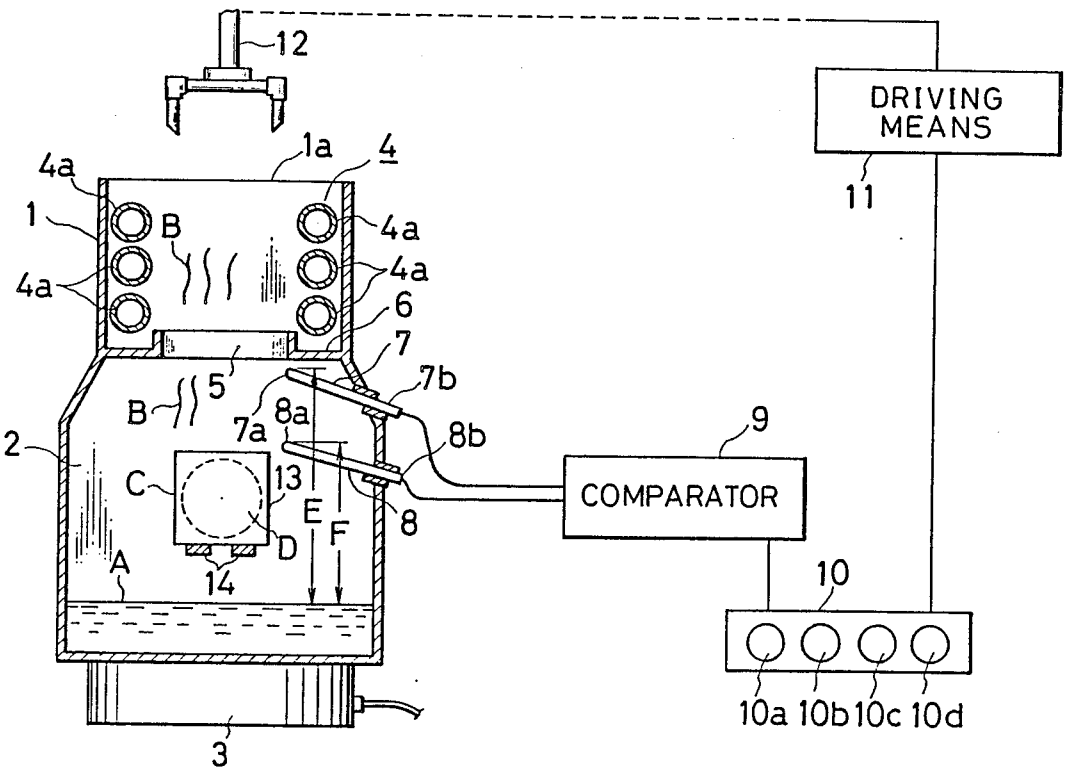
FIG. 2 shows a sectional view of an embodiment of the present invention.

In FIG. 2 there is shown a rinsing barrel 1. The upper surface of the rinsing barrel 1 is opened, and in the latter half part of the rinsing barrel 1 there is formed a rinsing chamber 2. In the bottom part of the rinsing chamber 2 rinsing solvents (A) such as isopropyl-alcohol (IPA) etc. are stored. The rinsing solvent (A) is heated by a heating means 3 disposed beneath the rinsing chamber 2 to evaporate, and with vapor (B) thereof the chamber 2 is filled.

In the upper half of the rinsing barrel 1 there is disposed a cooling means 4 having a plurality of cooling tubes 4*a*. These cooling tubes 4*a* cool the vapor (B) to dew so that they may prevent the vapor (B) from overflowing from the barrel 1, and the vapor can be recovered. The dewed solvent is received in a groove 6 which surrounds an opening 5 provided between the chamber 2 and the cooling means 4, and then is recirculated to the bottom of the chamber 2.

Two probes of thermometers 7 and 8 are disposed at the side wall of the chamber 2 by penetrating the wall. The first probe 7 is disposed at a position direct beneath the opening 5 and of which height from the surface of the solvent (A) is "E". On the other hand, the second probe 8 is disposed at a position of which height from the surface of the solvent (A) is "F" and a little higher than the upper edge of the materials to be rinsed. Data obtained by the two probes 7 and 8 are converted into electric signals by converters (not shown) each attached to the respective probes, and then in a comparator 9 the each of the measured values by the respective probes 7 and 8 is compared with a previously designated reference level. By basing on those compared results, according to a discriminating or judging system (which will be hereinafter described), rinsing situation is judged. A signal of the judgement are sent to an indicator 10 and a driving device 11.

The driving device 11 drives a handling device 12 by basing the signal of the judgement so that materials (C) may be fed in the rinsing chamber 2 and taken off therefrom. The indicator 10 comprises a plurality of lamps (shown in FIG. 2 as 4 lamps), and with the lamps (10*a*-)-(10*d*) the vapor height in the rinsing chamber 2 is indicated, and basing the situation of the vapor height, working processing is conducted. This will be described minutely hereinafter.

Materials to be rinsed are, in this embodiment, a plurality of semi-conductor wafers (D) accommodated in a cassette 13, and in the cassette 13 they are held on a bridge 14 in the rinsing chamber 2.

Figure 1:
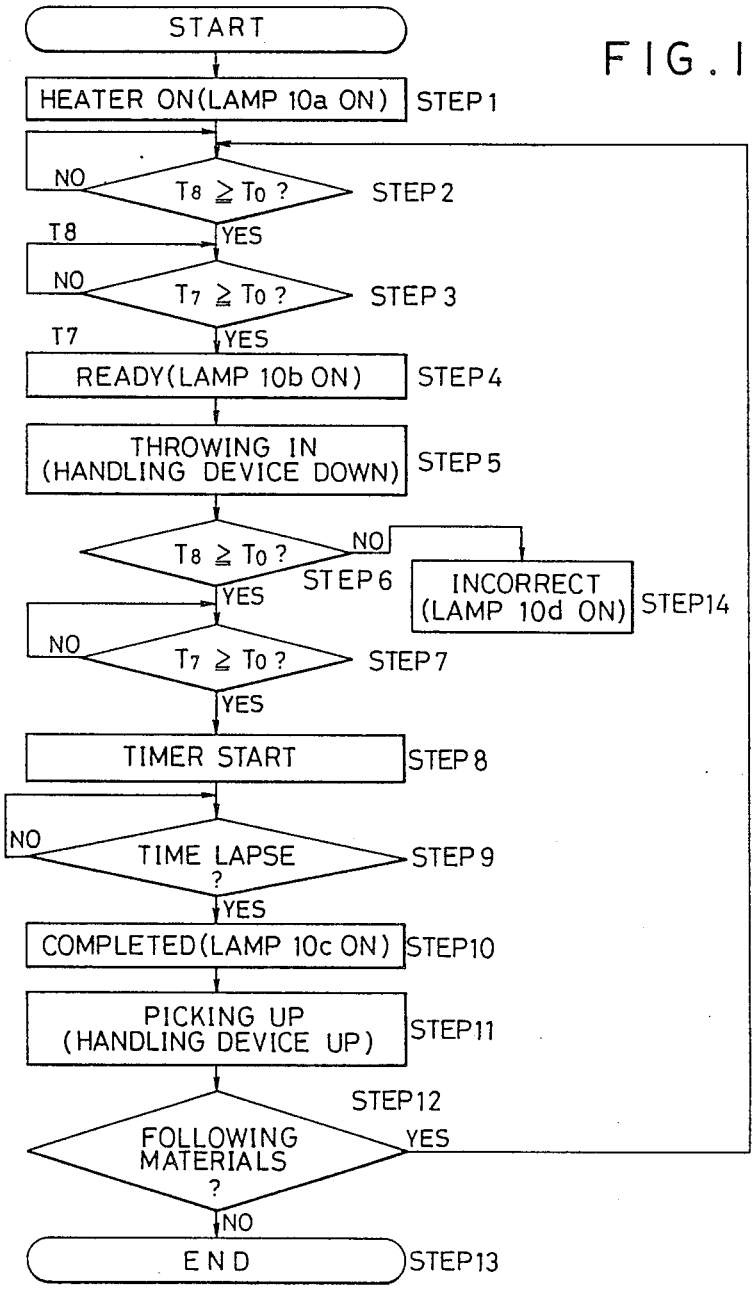
FIG. 1 is a flow chart of a method according to the present invention.

By referring to the flow chart shown in FIG. 1, operation of the rinsing apparatus according to the present invention will be described hereinafter.

STEP 1

When the apparatus is started to operate, the heating means 3 is switched on and rinsing the solvent (A) is heated up to the boiling point to evaporate the solvent, that is, vapor (B) is generated. Then the indicating lamp 10*a* is lit. The vapor (B) rises to pass through the opening 5 and is cooled by the cooling means 4 to be dewed. Then the dew drops in the groove 6 and is to be returned to the bottom of the chamber 2 passing through a pipe line (not shown). "The vapor height" is determined by the evaporated quantity and the dewed quantity of vapor, and further temperature of vapor at a position of a height where saturated vapor is filled is the boiling temperature of the rinsing solvent (A), so that, according to the measured values of the probes 7 and 8 of the thermometer, whether or not the vapor height is over each of the height of the probes 7 and 8 is detected, and basing on its result the heating means 3 and the cooling means 4 are controlled. As described the above, keeping a desired vapor height the process is advanced to STEP 2 and the following.

STEP 2

Temperature "T" obtained by the second (lower) probe 8 is detected by the comparator 9 whether the temperature "T" is equal to the reference value (saturated vapor temperature "T", as an example) or higher than it.

STEP 3

Temperature "T" obtained by the first (upper) probe 7 is detected by the comparator 9 whether the temperature "T" is equal to the reference value or higher than it.

STEP 4

If in the both STEPS 3 and 4 responses are "YES", the indicating lamp **10*b* is lit to indicate that in the chamber 2** vapor is filled and the rinsing operation can be carried out.

STEP 5

The handling device 12 is operated by the driving means 11, the cassette 13 in which materials (D) to be rinsed are accommodated is loaded in the chamber 2 through openings **1*a* and 5, and is set on the bridge 14. When low temperature materials (D) such as semi-conductor wafers are set, the vapor (B) dews on their surfaces, and by the dewed solvent the wafers (D) are rinsed. Because of vapor being dewed, volume of vapor in the chamber 2** is reduced temporarily, which results in lowering the "vapor height".

As the rinsing process advances, temperature of the wafers (D) rises, and quantity of vapor to turn to dew reduces, so that the "vapor height" gradually rises so that the atmosphere in the inside of the chamber may return to the previous situation in which the cassette 13 was not loaded.

Figure 3:
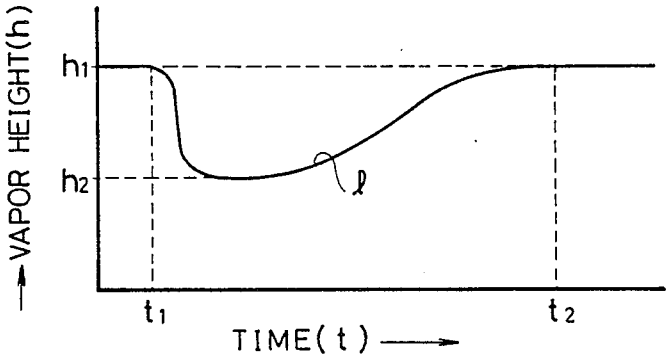
FIG. 3 is a chart of "the vapor height" variation relating with rinsing process time.
Figure 4:
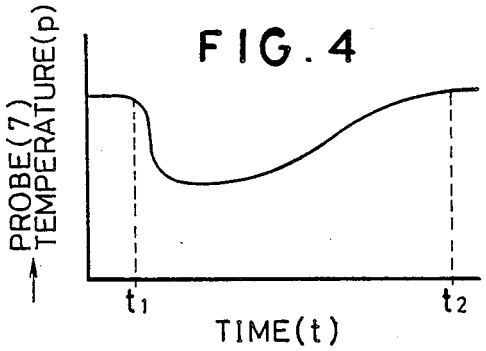
FIG. 4 shows "the vapor height" measured by a first probe.
Figure 5:
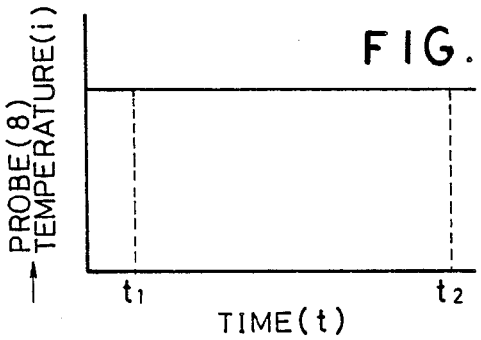
FIG. 5 shows "the vapor height" measured by a second probe.

In FIG. 3 there is shown a graph which represents variation of this vapor height, in the figure the longitudinal axis represents the vapor height (h) and the lateral axis designates processing time (t). The vapor height was $h_1$ before the materials are loaded, and after the materials are loaded, it drops precipitously from "$h_1$" when loading starts at "$t_1$" to a vapor height "$h_2$", and after a lapse of time "$t_2$" it returns to the original vapor height $h_1$ gently, that is, it is represented by a curve, as shown in FIG. 3. In FIG. 4 there is shown a graph which represents an output of the upper probe 7, also in FIG. 5 an output of the lower, i.e., the second probe 8 is represented. In the both figures, as same as in FIG. 3, they are represented basing on time axis, respectively.

By means of the upper probe 7 disposed at the upmost part of which height from the surface of the solvent is "E" ($E \leqq h_1$) of the rinsing chamber 2, variation of temperature dependent on variation of the vapor height is detected, while in the part of the lower probe 8 disposed at the shoulder height position of the materials, the height from the surface of the solvent being "F" ($F \leqq h_2$), always there is filled with saturated vapor, so that no change in temperature can be occurred. Accordingly, the fact that the part of the height at which the upper probe 7 is disposed is filled with saturated vapor is represented by its output, that is, if the vapor height "h" is higher than the position of the upper probe 7, i.e., "$h \geqq E$", it is noticed that the materials may be loaded.

STEP 7

Immediately after the materials being loaded, the vapor height falls temporarily lower than the height of the upper probe 7 ($h<E$), then, as the rinsing process advances, the vapor height begins to rise to return to the original level. When the vapor height returns to the original level, the comparator 9 detects the situation that the temperature "T" which is detected by the upper probe 7 is higher than the reference temperature "T".

STEP 8

Basing on a result of the afore-mentioned STEP 7, a timer means begins to start.

STEP 9

Rinsing time set in the timer means advances.

STEP 10

When the rinsing time passed, an indicating lamp **10*c* which indicates "finished" is lit. However, in some cases the timer means is not used, and also abbreviating the STEPs 8 and 9, it may be adapted to light the indicating lamp 10*c* when the vapor height is higher than the position of the upper probe 7**.

STEP 11

The finished signal is fed to the driving means 11 to descends the handling means 12 in the rinsing chamber 2, and takes up the cassette 13. When this STEPs finishes, the indicating lamp **10*c* is lit off. The driving means 11 may be automatically started with the finished signal, or may be manually started by an operator after having confirmed the indicating lamp 10*c*** having been lit.

STEP 12

In the case of there being further following cassettes, return to the STEP 2 and repeat the same process.

STEP 13

In the case of there being no following cassette, it should be "END".

STEP 6 AND STEP 14

In the course of the above described rinsing process, when the vapor height falls to a position lower than the position of the lower probe 8 ($h<F$), the fact that temperature "T" obtained by the lower probe 8 is lower than the reference level "T" is detected by the comparator 9. In this case if there occurs any failure, its situation is judged and an indicating lamp **10*d* which indicates incorrect conditions is lit. This means that the quantity of vapor which dews on the surfaces of the materials is too larger than that of the vapor evaporating from the bottom of the chamber 2, so that, then, by stopping the rinsing process, the materials are removed to power up the heater means 3**, or by reducing loading quantity of the materials, the rinsing operation is to be carried out.

As discussed above, the materials to be rinsed are positioned inside chamber 2, above the solvent (A) and just below probe 8 which allows probe 8 to accurately measure the temperature "T" of the vapor at the materials. As such, probe 8 may be used to accurately determine whether or not the temperature "T" of the vapor has fallen below a reference value, or to determine if the vapor height "h" has fallen below the position of probe 8 which would indicate a failure, or that the materials should be removed or reduced in quantity as explained above.

Further, the rinsing solvents which can be applied to the present invention, in addition to isopropyl-alcohol and trichloric-ethylene described in the beginning of the specification, chloric solvent can be also used, and as materials to be rinsed, except the afore-mentioned semiconductor wafers, also glass plate can be rinsed according to the present invention.

What is claimed are:

1. A method of vapor-rinsing semiconductor wafers comprising the steps of:

superheating and evaporating a rinsing solvent located in a rinsing chamber so as to fill an inside of said rinsing chamber with a steam of said rinsing solvent, said steam rinsing from a bottom of said chamber toward a top of said chamber;

disposing said wafers at a first level inside said rinsing chamber above said rinsing solvent between said bottom and said top of said chamber, said rinsing chamber constantly being filled with said steam at said first level;

forming condensates of said rinsing solvent on surfaces of said wafers thereby rinsing said wafers;

measuring the vapor temperature at said first level inside said rinsing chamber;

measuring the vapor temperature at a second level inside said rinsing chamber near said top of said chamber, said vapor temperature at said second level temporarily dropping below a reference value after said wafers are initially disposed inside said chamber at said first level indicating said steam has dropped below said second level within said chamber;

detecting when said vapor temperature at said second level recovers to said reference value which signifies completion of rinsing of said articles; and removing said wafers from said chamber.

2. A method of vapor-rinsing semiconductor wafers according to claim 1 wherein said wafers are kept inside said rinsing chamber for a certain period of time after said vapor temperature at said second level has reached said reference value before removing said wafers from said chamber.

3. A method of vapor-rinsing semiconductor wafers comprising the steps of:

superheating and evaporating a rinsing solvent located in a rinsing chamber so as to fill an inside of said rinsing chamber with a steam of said rinsing solvent, said steam rising from a bottom of said chamber toward a top of said chamber;

disposing said wafers at a first level inside said rinsing chamber above said rinsing solvent between said bottom and said top of said chamber;

forming condensates of said rinsing solvent on surfaces of said wafers thereby rinsing said wafers;

measuring the vapor temperature at a second level inside said rinsing chamber near said top of said chamber, said vapor temperature at said second level temporarily dropping below a reference value after said wafers are initially disposed inside said chamber at said first level indicating said steam has dropped below said second level within said chamber;

measuring the vapor temperature at said first level inside said rinsing chamber; and detecting when said vapor temperature at said first level is lower than a reference value in order to determine an occurrence of a rinsing failure.

4. A method for rinsing semiconductor wafers according to claim 3 wherein said reference value of said vapor temperature at said first level is the saturated vapor temperature of said rinsing solvent.

5. A method for rinsing semiconductor wafers according to claim 4 wherein lowering said vapor temperature at said first level below said saturated vapor temperature causes an alarm to be triggered.

6. A method for rinsing semiconductor wafers according to claim 5 further comprising the step of taking at least some of said wafers out of said chamber simultaneously with the triggering of said alarm.

7. A method for rinsing semiconductor wafers according to claim 5 further comprising the step of: after triggering said alarm, immediately removing said wafers and heating said rinsing solvent in order to superheat and evaporate said rinsing solvent.

* * * * *